United States Patent [19]

Goto et al.

[11] 4,158,349

[45] Jun. 19, 1979

[54] IGNITION TIMING CONTROL SYSTEM FOR AN INTERNAL COMBUSTION ENGINE

[75] Inventors: Osamu Goto, Kurume; Masao Watanabe, Asaka; Yoshio Kadoshima, Saitama, all of Japan

[73] Assignee: Honda Giken Kogyo Kabushiki Kaisha, Tokyo, Japan

[21] Appl. No.: 748,660

[22] Filed: Dec. 8, 1976

[30] Foreign Application Priority Data

Dec. 11, 1975 [JP] Japan ..... 50/166289

[51] Int. Cl.[2] ..... F02P 5/10

[52] U.S. Cl. ..... 123/117 A; 123/117 R

[58] Field of Search ..... 123/117 A, 117 R, 146.5 A

[56] References Cited

U.S. PATENT DOCUMENTS

| | | | |
|---|---|---|---|
| 3,650,253 | 3/1972 | Cooksey | 123/117 A |
| 3,687,120 | 8/1972 | Lenz | 123/117 A |
| 3,793,833 | 2/1974 | van Basshuysen | 123/117 A |
| 3,923,023 | 12/1975 | Ito et al. | 123/117 A |
| 3,978,831 | 9/1976 | Yoshikawa | 123/117 A |
| 4,016,844 | 4/1977 | Tanaka et al. | 123/117 A |
| 4,022,169 | 5/1977 | Tanaka et al. | 123/117 A |
| 4,030,460 | 6/1977 | Tanaka et al. | 123/117 A |
| 4,031,869 | 6/1977 | Onishi et al. | 123/117 A |
| 4,068,634 | 1/1978 | Tanaka et al. | 123/117 A |
| 4,077,373 | 3/1978 | Nakano et al. | 123/117 A |

FOREIGN PATENT DOCUMENTS

| | | | |
|---|---|---|---|
| 2458458 | 6/1975 | Fed. Rep. of Germany | 123/117 A |

*Primary Examiner*—Charles J. Myhre
*Assistant Examiner*—Andrew M. Dolinar
*Attorney, Agent, or Firm*—Lyon & Lyon

[57] ABSTRACT

An ignition timing control system for an internal combustion engine, including a vacuum actuator connected to turn a point base about the axis of the rotary cam which operates the breaker points to advance or retard the ignition timing. The vacuum actuator employs two vacuum chambers, one used primarily to advance the timing, the other used to retard the timing. Each chamber communicates with an engine intake passage downstream from a throttle valve. Electromagnetic selector valves, one associated with each vacuum chamber, serve to connect each vacuum chamber to the engine intake passage, or alternatively to vent each vacuum chamber to atmosphere. These selector valves may be energized by a temperature switch, a velocity switch or a cruise switch. A check valve maintains vacuum intensity in the spark advance chamber when the vacuum intensity at the engine intake passage is lowered by virtue of the opening of the throttle valve.

2 Claims, 1 Drawing Figure

IGNITION TIMING CONTROL SYSTEM FOR AN INTERNAL COMBUSTION ENGINE

Figure 1:
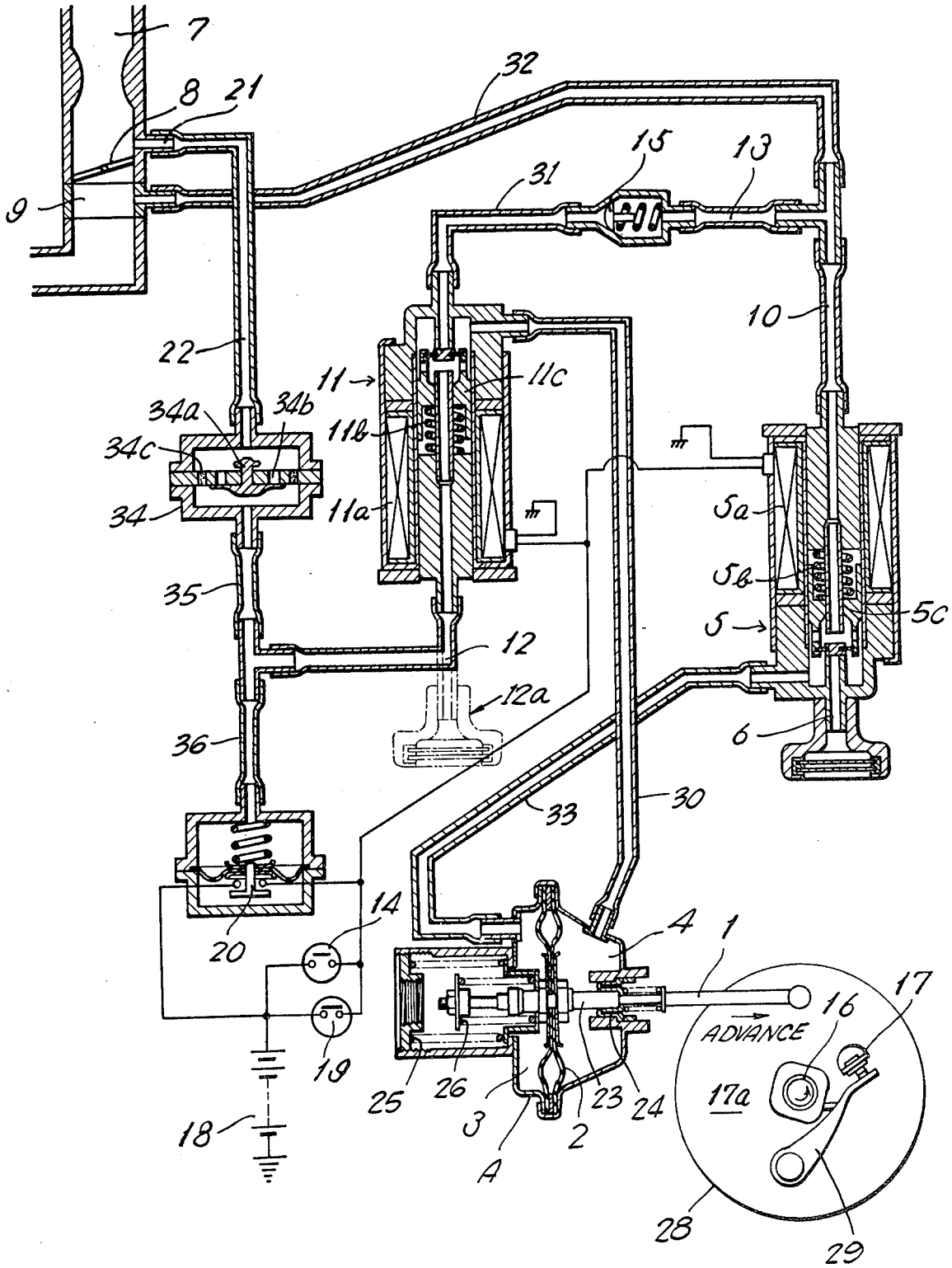

The present invention is directed to an ignition timing control system. More specifically, the ignition timing control system of the present invention is responsive to engine temperature, engine speed, or cruising of the vehicle powered by the engine.

Conventional prior art systems have been provided with a vacuum actuator having a diaphragm which is connected to a control member of the ignition timing apparatus. In such systems, a vacuum chamber for retarding the spark is defined on one side of the diaphragm and a separate vacuum chamber for advancing the spark is defined on the other side of the diaphragm. When the engine temperature is low, the vacuum chamber for spark retarding is vented to the atmosphere and the vacuum chamber for spark advancing is connected to a vacuum source to advance the ignition timing. The above system, however, has the disadvantage that when the throttle valve is opened widely, the vacuum at the engine intake passage becomes weak and approaches atmospheric pressure. This in turn reduces the intensity of the vacuum at the spark advancing chamber, and as a consequence advanced ignition timing is not maintained.

Accordingly, one of the objects of this invention is to provide a system which is free from such disadvantage and which causes the vacuum intensity in the advancing chamber to be retained at a high level even when the throttle valve is opened widely.

Other and more detailed objects and advantages will appear hereinafter.

In the drawing:

FIG. 1 is a schematic diagram, partly in section, showing a preferred embodiment of the invention.

Referring to the drawing, the vacuum actuator A comprises a main housing surrounding a movable wall or diaphragm 2, to create vacuum chambers 3 and 4. Movably positioned through the actuator A is an actuator 23 conventionally associated with the diaphragm 2. The actuator 23 is fixed to the control rod 1 so that pressure differentials on the diaphragm 2 will result in advancement or retardation of the ignition timing. A seal 24 prevents leakage of air. Two springs 25 and 26 allow adjustable resistance to motion of the actuator 23 in either direction.

Control rod 1 is connected by its projecting end to a point base 17*a* of conveitonal design. The contact breaker cam 16, a contact point 17, and point base 17*a* are conventional.

Vacuum chambers 4 and 3 may be alternatively connected to a vacuum source 9 at an intake passage of the engine, or to the atmosphere as follows: Advance vacuum chamber 4 may communicate with an engine intake passage 7 by means of vacuum passages 30, 31, 13 and 32, while second vacuum chamber 3 may communicate with the same engine intake passage 7 by means of vacuum passages 33, 10 and 32. Selector valve 11 is interposed between vacuum passages 30 and 31, while selector valve 5 is interposed between vacuum passages 33 and 10. Valves 5 and 11 are duplicates, of an electromagnetic type which is selectively actuated by operating solenoid coils 5*a* and 11*a*. The armatures 5*c* and 11*c* of these solenoids act against return springs 5*b* and 11*b*, respectively, when energized. Energy is supplied by power source 18 and is transmitted upon closing of any one of the electric switches 14, 19 or 20. Thus, upon actuation of one or more of these switches, the solenoid in first selector valve 11 is energized, pulling the movable armature 11*c* down against the spring 11*b*, allowing vacuum passages 30 and 31 to communicate. The vacuum at the intake passage below the throttle valve 8 is thus transmitted to first vacuum chamber 4 to advance the spark. Simultaneously, retard control valve 5 is electrically energized, pulling the movable armature 5*c* up against the spring 5*b*, venting the second vacuum chamber 3 to the atmosphere through vacuum passage 33 and atmosphereic vent passage 6. Thus, atmospheric pressure acts on the left side of the diaphragm 2 through second vacuum chamber 3 and a vacuum acts on the right side of the diaphragm through first vacuum chamber 4, causing the spark setting of the engine to be advanced.

Check valve 15 is placed between vacuum passage 31 and vacuum passage 13. This check valve opens only when the vacuum at the vacuum source 9 is greater than the vacuum intensity in the vacuum chamber 4, as will be further explained. The temperature switch 14 closes when the engine temperature is low, the velocity switch 19 closes upon high speed running, and the cruising switch 20 closes when a cruising or steady state operating condition of the automobile exists. One of or both of these velocity and cruising switches may be provided and placed in parallel with temperature switch 14. Cruising switch 20 is a diaphragm type switch which is activated by the vacuum intensity slightly upstream of the throttle valve 8 as sensed through outlet 21, vacuum passage 22, check valve 34 and vacuum passages 35 and 36. Check valve 34 allows a slow vacuum build-up in said vacuum actuated switch 20. The construction and operation of the check valve 34 is described in the copending application of Tanaka et al Ser. No. 602,436 filed Aug. 6, 1975. The movable valve element 34*a* closes the ports 34*b* against flow in one direction while the porous inserts 34*c* allow slow flow in either direction.

Thus, at low engine temperatures, the solenoid valves 5 and 11 are activated by closing of temperature switch 14. As the engine temperature increases to open temperature switch 14, actuation of the solenoid valves 5 and 11 may be maintained by virtue of velocity switch 19 or cruising switch 20 which is activated by the opening of throttle valve 8 when the vehicle maintaines steady state running.

In operation, when a low engine temperature is sensed, temperature switch 14 closes, thus energizing both control valves 5 and 11. The vacuum intensity in first vacuum chamber 4 is thus caused to build up by virtue of the fact that the chamber communicates with the engine intake passage 7 through vacuum passage 30, control valve 11, vacuum passage 31, check valve 15, and passages 13 and 32. Correspondingly, second vacuum chamber 3 is vented to the atmosphere by virtue of the activation of control valve 5. Diaphragm 2 is thus caused to move toward the right, rotating the point base 17*a* through control rod 1, causing the ignition timing to advance.

When the throttle valve 8 is opened widely, the vacuum intensity at intake vacuum source 9 grows very weak and approaches atmospheric pressure. This causes the vacuum intensity in first vacuum chamber 4 to weaken correspondingly, but for check valve 15 which is kept closed during this variation of vacuum intensity.

Consequently, vacuum intensity is maintained and the ignition timing is held in an advanced position.

When throttle valve 8 is maintained open and the vehicle is kept running at a high speed or cruising condition, switches 19 and 20 are caused to close and advanced ignition timing is maintained even when the temperature switch 14 is opened as a result of a temperature increase. Thus, vacuum intensity for purposes of ignition timing advance is maintained, thus eliminating the disadvantages of conventional systems, as described above. Before selector valve 11 is energized, first vacuum chamber 4 in said diaphragm valve is vented through passages 12 and 22.

In the modified form of the invention shown by phantom lines illustrating an atmospheric vent 12*a*, the connecting passage 12 is not employed. The control valve 11 vents the passage 30 through the atmospheric vent 12*a* instead of through the passage 35, check valve 34 and passage 22. Venting of the vacuum chamber to atmosphere occurs more rapidly.

Having fully described our invention, it is to be understood that we are not to be limited to the details herein set forth, but that our invention is of the full scope of the appended claims.

We claim:

1. For use with an internal combustion spark ignition engine for driving a vehicle, the engine having an intake passage provided with a throttle valve, an ignition timing control apparatus for the engine comprising, in combination: a timing adjustment mechanism, an actuator assembly for operating said mechanism, said actuator assembly including a first vacuum chamber formed on one side of a flexible diaphragm and a second vacuum chamber formed on the other side of said diaphragm, means for connecting said diaphragm to operate said timing adjustment mechanism, means including a vacuum passage for connecting each of said vacuum chambers to said engine intake passage downstream from said throttle valve, the latter said means including a first control valve for said first vacuum chamber and a second control valve for said second vacuum chamber, each control valve being movable from a position venting its respective vacuum chamber to a second position connecting that vacuum chamber to said vacuum passage, means including electrical switch means for energizing both of said control valves to apply vacuum pressure to said first chamber and to vent said second chamber, and thereby advance the ignition timing, and a first check valve operatively interposed between said first control valve and said vacuum passage to maintain vacuum intensity in said first chamber, said first control valve being further defined as communicating with said engine intake passage upstream from said throttle valve through a second vacuum passage, a second check valve in said second passage, a cruise switch closed by suction pressure in said second vacuum passage, said cruise switch constituting a part of said electrical switch means.

2. For use with an internal combustion spark ignition engine for driving a vehicle, the engine having an intake passage provided with a throttle valve, an ignition timing control apparatus for the engine comprising, in combination: a timing adjustment mechanism, an actuator assembly for operating said mechanism, said actuator assembly including a first vacuum chamber formed on one side of a flexible diaphragm and a second vacuum chamber formed on the other side of said diaphragm, means for connecting said diaphragm to operate said timing adjustment mechanism, means including a vacuum passage for connecting each of said vacuum chambers to said engine intake passage downstream from said throttle valve, the latter said means including a first control valve for said first vacuum chamber and a second control valve for said second vacuum chamber, each control valve being movable from a position venting its respective vacuum chamber to a second position connecting that vacuum chamber to said vacuum passage, means including electrical switch means for energizing both of said control valves to apply vacuum pressure to said first chamber and to vent said second chamber, and thereby advance the ignition timing, and a check valve operatively interposed between said first control valve and said vacuum passage to maintain vacuum intensity in said first chamber wherein a second vacuum passage communicates with said engine intake passage upstream from said throttle valve, a cruise switch closed by suction pressure in said second vacuum passage, said cruise switch constituting a part of said electrical switch means and further wherein said first control valve is vented to said second vacuum passage.

* * * * *